US006044767A

United States Patent [19]

Myus et al.

[11] Patent Number: 6,044,767

[45] Date of Patent: Apr. 4, 2000

[54] SLOTLESS ELECTRIC TRACK FOR VEHICLES

[76] Inventors: David Allan Myus, 105 Timberidge Dr., Greer, S.C. 29650; Charles Weaver Weisel, Jr., 109 Pine Straw Way, Greenville, S.C. 29607

[21] Appl. No.: 09/261,469

[22] Filed: Feb. 4, 1999

Related U.S. Application Data

[60] Division of application No. 08/815,875, Mar. 11, 1997, Pat. No. 5,868,076, which is a continuation-in-part of application No. 08/608,257, Feb. 28, 1996, abandoned.

[51] Int. Cl.[7] ..... A63K 1/00

[52] U.S. Cl. ..... 104/60; 104/295; 104/304; 238/10 R; 191/45 R

[58] Field of Search ..... 104/53, 60, 295, 104/296, 297, 304, 301; 238/10 R; 191/45 R, 49

[56] References Cited

U.S. PATENT DOCUMENTS

| | | | |
|---|---|---|---|
| 1,668,249 | 5/1928 | Rich | 104/60 |
| 2,691,946 | 10/1954 | Marmo . | |
| 2,717,557 | 9/1955 | Seyffer | 104/60 |
| 3,205,618 | 9/1965 | Heytow | 104/304 |
| 3,391,490 | 7/1968 | Evans | 104/304 |
| 3,400,667 | 9/1968 | Case et al. | 104/60 |
| 3,581,668 | 6/1971 | Ingels . | |
| 3,705,387 | 12/1972 | Stern et al. | 104/297 |
| 4,200,287 | 4/1980 | Ryan et al. | 104/304 |
| 4,322,079 | 3/1982 | Cooper et al. | 104/304 |
| 4,415,157 | 11/1983 | Lahr . | |
| 4,453,712 | 6/1984 | Lee . | |
| 4,479,650 | 10/1984 | Neuhierl . | |
| 5,160,091 | 11/1992 | Hesse . | |

FOREIGN PATENT DOCUMENTS

| | | | |
|---|---|---|---|
| 1091384 | 4/1955 | France | 104/304 |

*Primary Examiner*—Mark Le
*Attorney, Agent, or Firm*—Dority & Manning

[57] ABSTRACT

An improved track and vehicle system are provided for model electric vehicles. The track system includes a number of interconnectable panels having alternate portions of negative and positive polarity conductor strips defined on a top surface thereof. The conductive strips are separated by non-conductive portions. Each of the panels includes electrical and mechanical interlocking devices carried on each side thereof so that any one panel can have additional panels connected on each of its sides. The vehicles include a unique arrangement of contacts carried on a linkage underneath of the vehicle to ensure that the vehicle remains at all times in contact with the conductors, regardless of the direction of movement of the vehicle from the surface of the panels.

8 Claims, 7 Drawing Sheets

SLOTLESS ELECTRIC TRACK FOR VEHICLES

This application is a Divisional Application of U.S. patent application Ser. No. 08/815,875 filed on Mar. 11, 1997 now U.S. Pat. No. 5,868,076. The parent '875 application was a Continuation-in-Part application of U.S. Ser. No. 08/608,257 filed on Feb. 28, 1996 now abandoned.

BACKGROUND OF THE INVENTION

This invention is directed towards an improved track and system for electric race cars and other electric powered and remotely controlled vehicles.

It is known within the art to provide scaled versions of electric race cars which are designed to run within defined slots of an electric track. Typically, two cars at a time can compete on a dual-slotted track. However, the traditional arrangement confines each car within a single slot with no steering capability. Instead, the operator is limited to controlling the vehicle solely by speed.

Attempts within the industry to provide lane-changing capability for electric tracks have had limited success. It is known to provide separate electrified lanes within a race track. However, a reoccurring problem involved power loss and stalling when a car passed from one lane to an adjacent lane. If stalled, the car had to be manually placed back on the track. Further, the lane changing capability still limited cars to only one of two lanes. Accordingly, the lane-change capability provides a very limited duplication of an actual race course and racing strategy.

It is also known within the art to provide battery powered vehicles which can be remotely controlled about the track or any other desired terrain. However, peak power performance for these cars is as little as twenty minutes before replacement of high-cost batteries is required. Further, the inconvenience of recharging or replacing batteries detracts from racing. While gas-powered vehicles are known and can run for longer periods of time, they are noisy, require the use of hazardous fuel, and are not suitable for small children or indoor use.

Accordingly, there is room for improvement and variation within the art of electric track systems for powering cars and other remotely controlled vehicles and apparatuses.

OBJECTS AND SUMMARY OF THE INVENTION

It is an object of this invention to provide an improved electric track system which enables a user to vary the speed, direction, and pathway of the vehicle anywhere along the track.

It is a further and more particular object of this invention to provide an improved electric track system for maintaining electrical flow between the electric track and a moving vehicle.

It is a further and more particular object of this invention to provide a remotely controlled vehicle which is powered through an electric current, accessible to the vehicle at any point along the length or width of the track.

It is a further and more particular object of the invention to provide a remotely controlled vehicle whose control capability is provided by information transmitted through the track.

It is still a further and more particular object of this invention to provide an electric platform suitable for use with remotely controlled objects to permit individual movement and control of the objects, such as simulated games such as soccer, hockey, or other interactive or competitive sports can be performed.

These as well as other objects of the invention are provided by an electrified track apparatus comprising: a nonconductive platform defining a plurality of spaced conductors of alternating positive and negative polarity, the conductors being substantially flush with a surface of the platform; a remotely controlled electric vehicle having a linkage array carried by the vehicle, the linkage array maintaining at least one conductive surface in communication with one of the positive conductors and a second conductive surface in communication with one of said negative conductors whenever the car is positioned on the platform; a voltage rectifier circuit for supplying a respective positive and a negative voltage to the car; wherein when the vehicle is on the platform, the contacts maintain an operative electrical connection with the conductors at all times, thereby permitting the vehicle to be operated along all points and in any direction relative to the platform.

DETAILED DESCRIPTION OF THE PREFERRED EMBODIMENTS

Figure 1:
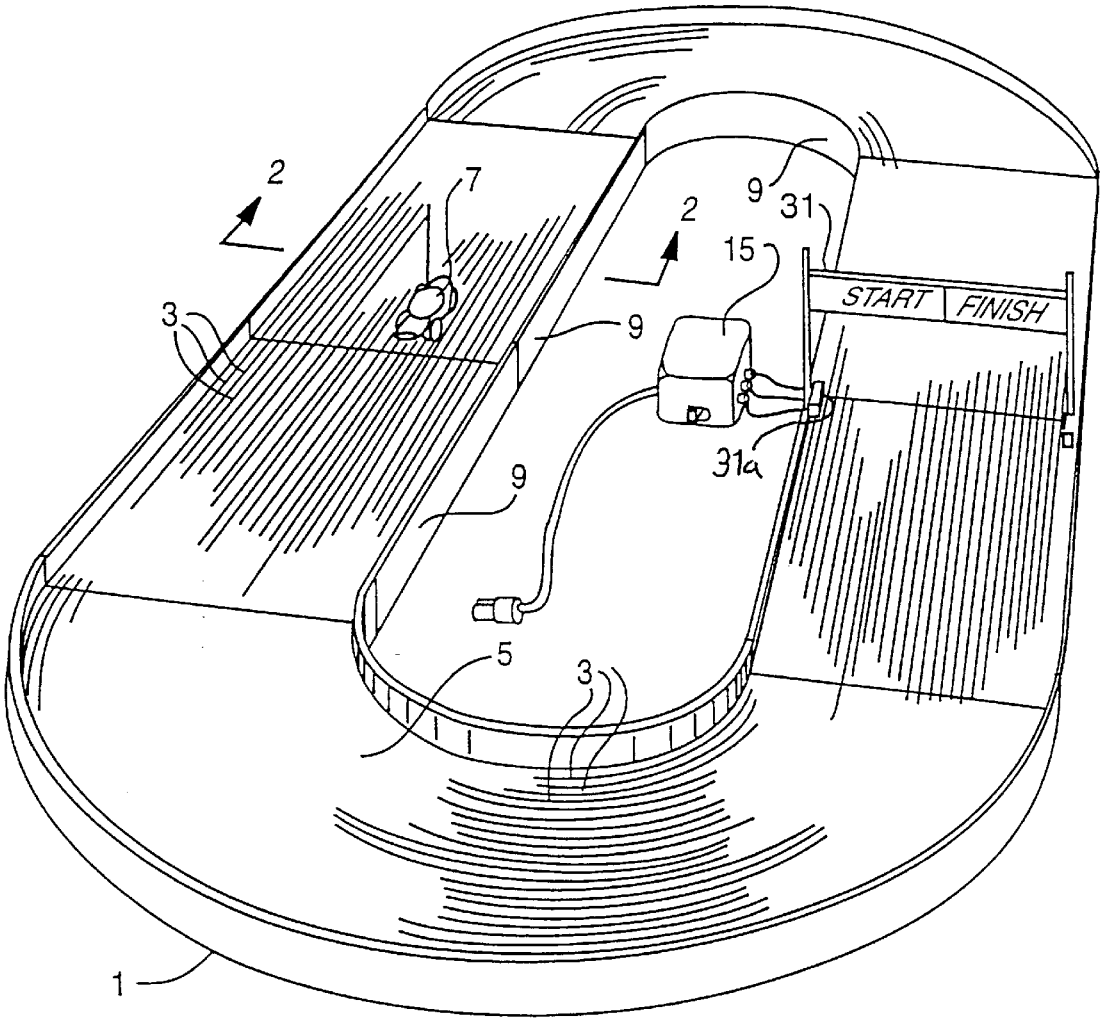
FIG. 1 is a perspective view of a preferred embodiment of a track surface and vehicle in accordance with the instant invention.

A preferred embodiment of the present invention, as seen in reference to FIG. 1, provides a platform 1 having an oval track layout. Platform 1 is preferably provided of a non-electrically conductive material such as wood, plastic, or fiberglass. The plurality of electrical conductive strips 3 are carried on an upper surface 5 of platform 1. In a preferred embodiment, strips 3 are substantially flush with surface 5 so as to provide an even upper track surface for the operation of a car 7.

The flush position of strips 3 can be provided by using a flat conductor, such as braided cable or metal strips. In addition, the conductors can be installed within grooves defined by upper surface 5. Flat braided cable is a preferred material in that it provides sufficient texture to maintain a good electrical connection with moving contacts of car 7 and is readily available in bulk rolls and a variety of useful widths, thicknesses, and conforms easily to track curvatures and innovative track layout designs. Metal strips can also be provided in bulk, which are stamped to conform to any desired curvature or dimension.

The conductive strips 3 are connected to a low-voltage source 15 such that the conductive track portions are arranged in a repeating pattern between positive and negative conductors separated by an insulated space 4. Preferably, the voltage is under 25 volts and is similar to that used in prior art slotted race tracks which avoids possible shock hazards. The initial test platform evaluated as part of this invention was operated at 8.8 volts, which allowed a 7.2 D.C. voltage to be provided, which matched the voltage requirements of the test vehicle. However, a variety of operating voltages can be used with a properly matched vehicle. While the track voltage can be either alternating current or direct current, direct current is preferred for the ease in regulating direct current voltage sources. Direct current requires less filtering or stabilizing of the voltage supplied to the electrical system of the car. Of course, if A.C. is used, individual strips 17 and 19, or alternative shaped conductive portions of the platform, are not in a permanent positive or negative relationship.

A variety of alternative platforms can be provided. For instance, platform 1 may be provided by a metal grid in which the conductive strips are separated by the open portion of the grid. In such an embodiment, the open portion provides the nonconductive separation between the conductive portions of the platform. Nonconductive cross-connectors are used to physically link the platform into one functional unit.

It has also been found that the conductive strips 3 can be raised relative to the insulated portion of the platform. In such embodiments, providing a rolled edge to the platform conductors makes for a smoother surface for the vehicle. Depending upon the height of the raised conductor, the insulating feature of the track may be provided solely by the space defined between the conductive portions.

Conductive portions can also be coated with a nonconductive material, such as plastic, affixed along the bottom of the conductor. This embodiment permits the platform to be of any material whether conductive or nonconductive. While a preferred embodiment is illustrated and described in reference to a strip of continuous conducting material, a platform having a checkered pattern of alternating positive and negative portions with insulated areas therebetween would also be sufficient. Such a design may also offer advantages in design simplicity of the vehicle's linkage array as described below. With precise control of the dimensions of the conductors and linkage array, a platform can be provided in which the conductors are provided by a repeating pattern of virtually any geometric shape.

As best seen in reference to FIG. 1, platform 1 can be provided by a plurality of interlocking panels 9. In addition to the mechanical interlocking feature, each panel is designed to maintain the electrical connection to the conductive strip of the adjacent panel when placed in an interlocked position. A variety of well known and conventional connectors can be used to maintain the electrical pathway such as a pin-and-socket arrangement (FIG. 5), mechanical clips, pressure contact points, or other well known means typically employed for prior art slotted race tracks.

Figure 5:
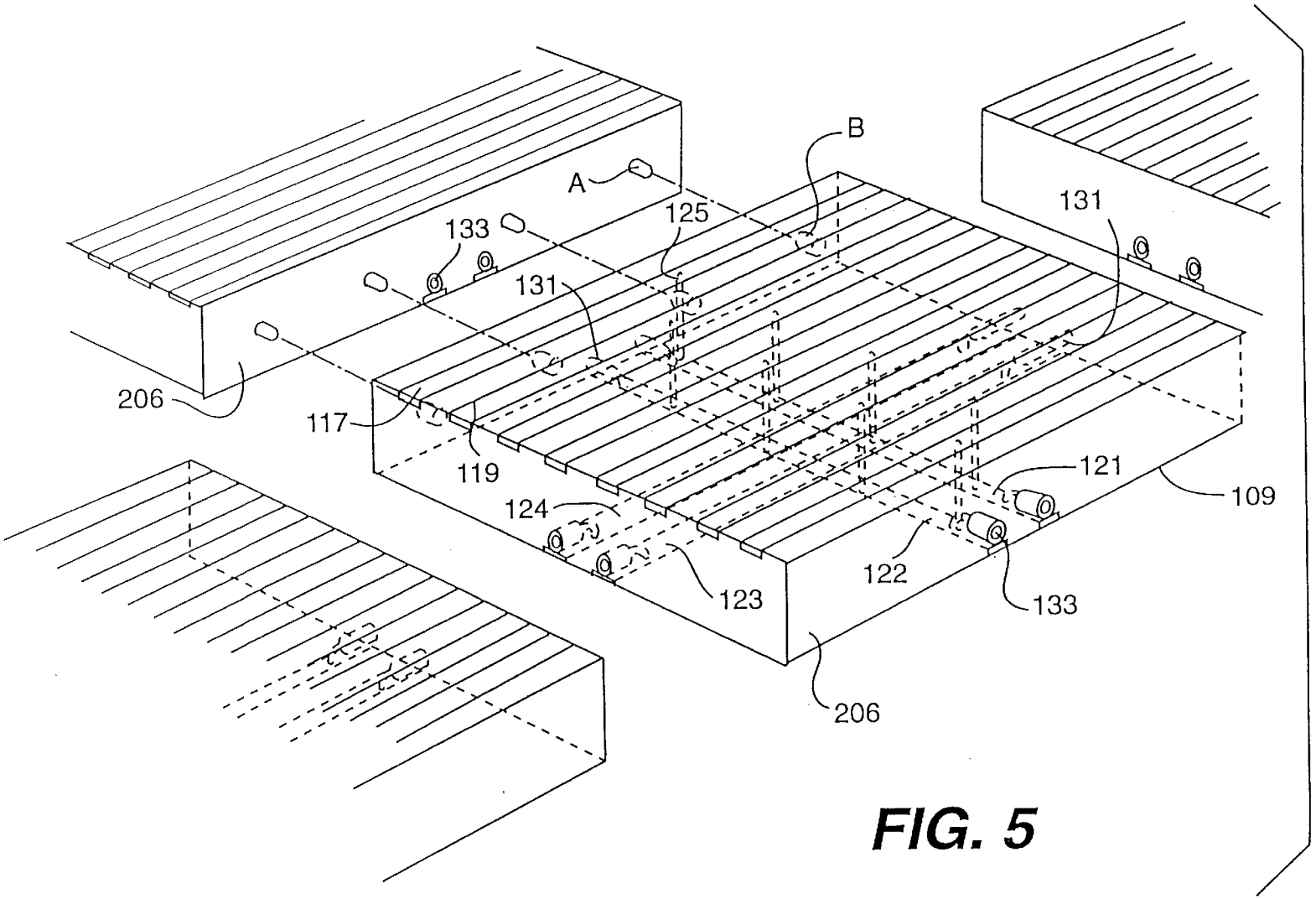
FIG. 5 is a perspective view showing internal details in phantom of a preferred panel construction in accordance with this invention.

As seen in reference to FIG. 5, an additional preferred embodiment of a panel 109 is provided by an upper pattern of positive 117 and negative 119 conductive material in the form of parallel strips of metal separated by an insulated gap region. Within an interior of panel 109 a first pair of conductors defined by strip 121 and strip 122 are provided which connect two opposing panel edges. A second pair of conductors defined by strips 123 and 124 connect the two other opposite panel edges. Where the first and second conducting pairs intersect, the conductors of like polarity are in communication, while unlike polarity conductors remain insulated from one another.

The arrangement of conductor pairs allows each panel to be in electrical communication with attached adjacent panels. Electrical communication with the upper conductor portions 117 and 119 is provided by conductive leads 125 which connect each positive strip 117 to the underlying positive strip 121. Likewise, each negative upper strip 119 is attached to a portion of the underlying negative conductor 122. Linkages between adjacent panels can be provided by conventional pin-and-socket connectors 132 and 133 so that as each adjacent panel is installed, the platform's polarity and electrical continuity is maintained. In this manner, only a single connection between the power source and one panel needs to be provided, each panel thereafter maintaining the necessary electrical connection with all adjacent panels. The above embodiment is well suited for mass production and opens up numerous possibilities for innovative platform design layouts which could be in the form of oval tracks, rectangular platforms, as well as end-to-end connections which can be used to mimic roadways. The prefabricated panel sections allow the user to vary the size and complexity of the course beyond that provided as an initial basic package.

As an additional feature, portions of the panel can provide for slight flexing or hinged movement of the upper panel surface. In this way, the platform can have a variable terrain and permit slight banking of a track surface for better turning capabilities (not shown).

Figure 3:
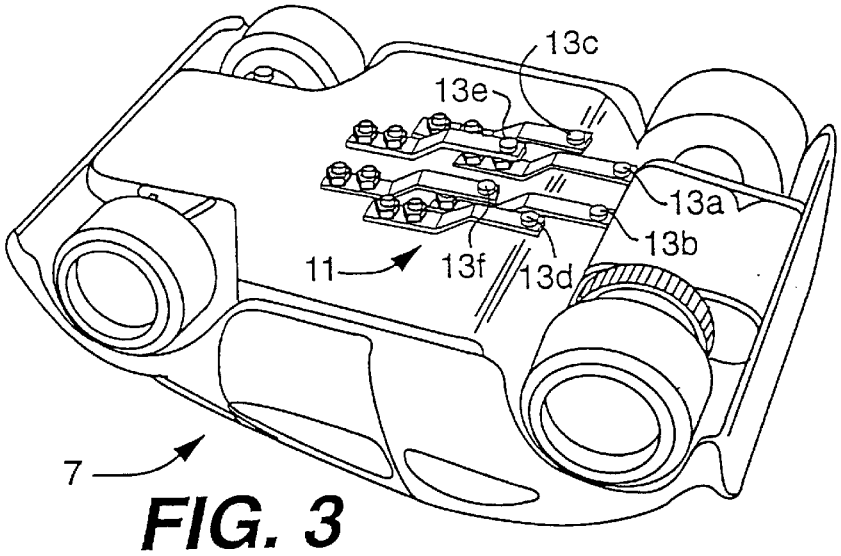
FIG. 3 is a perspective view of an electrical linkage and vehicle in accordance with this invention.

A critical feature of the instant invention is the relationship between the plurality of alternating positive and negative conductors and the dimensions and spacing of a conductive linkage 11 as best seen in FIG. 3. Linkage 11 is carried by a lower surface of car 7 and designated such that at all times when the car is properly positioned on the track, at least one contact (13*a*, 13*b*, 13*c*, 13*d*, 13*e*, and 13*f*) of the linkage will touch a positive conductive strip 3 and a second contact will touch a negative conductive strip 3. As seen in reference to FIG. 3, a linkage array 11 is provided having six (6) contacts (13*a*, 13*b*, 13*c*, 13*d*, 13*d*, and 13*f*). When linkage 11 is positioned at any location or orientation on the track, at least one linkage contact will touch a positive strip and a separate linkage contact 13 will touch a negative strip. This arrangement maintains a flow of current from the conductive strips through the conductive surfaces of linkage 13 and into the electrical system of the car 7, regardless of the direction of movement of the vehicle on the platform.

While not wanting to be unduly limited by theory, it is believed that a linkage in accordance with this invention for parallel platform conductors must comprise at least four contacts in order to maintain electrical connection between the car and any track using conductive strips. For instance, a linkage array of three contacts would be inoperative since it is possible for two of the contacts to be in communication with the insulated space of the track at the same time. When so positioned, the third remaining contact cannot complete the needed circuit.

A platform having a checkered array of alternating conductive positions could have a linkage with as few as three (3) properly sized and spaced conducting portions.

Figure 2:
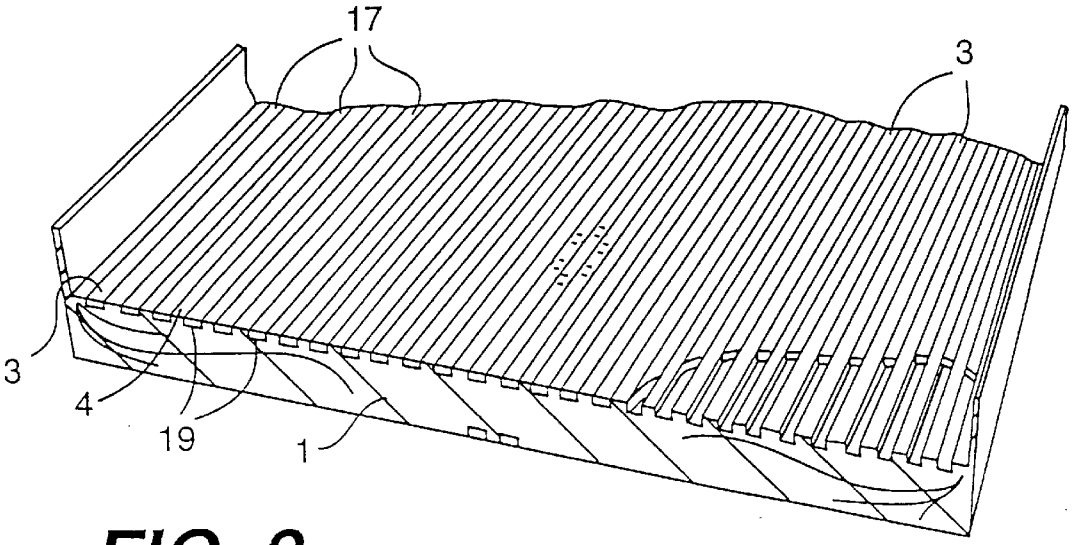
FIG. 2 is a sectional view of a panel section taken along line 2—2 of FIG. 1.
Figure 2A:
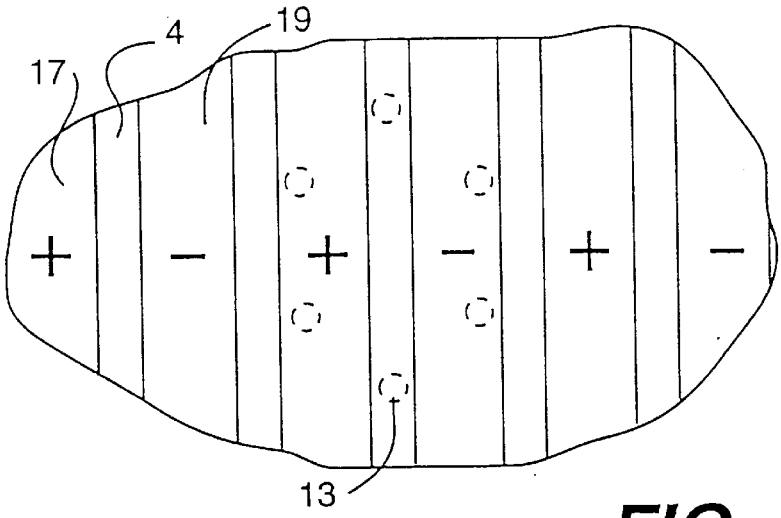
FIG. 2A is a top plan view of panel section as seen in FIG. 2 illustrating a plurality of spaced conductive strips as seen in relation to the contact portions of a conductive linkage.

As seen in reference to FIG. 2A, the position of the conductive portion of a six-contact linkage 11 is seen in reference to a corresponding track portion having adjacent conductors of positive and negative charge. As seen and as can be readily understood from the figure, at any position along the track, linkage 11 will always provide at least one contact touching a negative strip and at least one contact touching a positive strip. It is readily appreciated by those having skill in the art that the size of an individual contact 13 must be smaller than the width of the insulated gap; otherwise, a single contact could simultaneously engage adjacent positive and negative strips, thereby creating a short circuit. The linkage 11 is provided from a beryllium copper strip having defined circular contacts 13.

Preferably, linkage array 11 is heated after being formed, which tempers the metal strips and increases their stiffness. However, a variety of other linkage materials and linkage configurations can be used.

As best seen in reference to FIGS. 2A and 3, as linkage 11 and contacts 13 slide across the upper surface of the platform, any single contact will likely engage in a rapid fashion a succession of positive strips, negative strips and nonconductive gap portions of the platform. Contacts 13 must maintain the respective electrical connections while sliding relative to the strips. Accordingly, having a linkage array with more than the minimum number of contacts helps maintain an even flow of current and reduces the need for voltage stabilizing.

Since any one contact varies in whether it is in communication with a positive strip, a negative strip, or an insulated gap, each contact is preferably connected to two rectifiers. Silicon diodes 18 are used with the present invention and are commercially available. As seen in FIG. 5, each rectifier directs current from the contact to (or from) either the positive or negative supply bus, depending upon whether the contact 13 is touching a positive or negative conductor strip 3. Each contact can therefore serve as a positive or negative contact at any time.

The rectified voltage received through contacts 13 of linkage 11 may require filtering or stabilizing by the use of capacitors 21 or other energy storage devices to help maintain a constant mechanism which occurs between moving linkage 13 and the strips 3 can be intermittent at times as a result of slight imperfections in the surface areas of the contacts 13 and the track. Also, vehicle vibrations and similar movements may also contribute to an intermittent connection.

Figure 4:
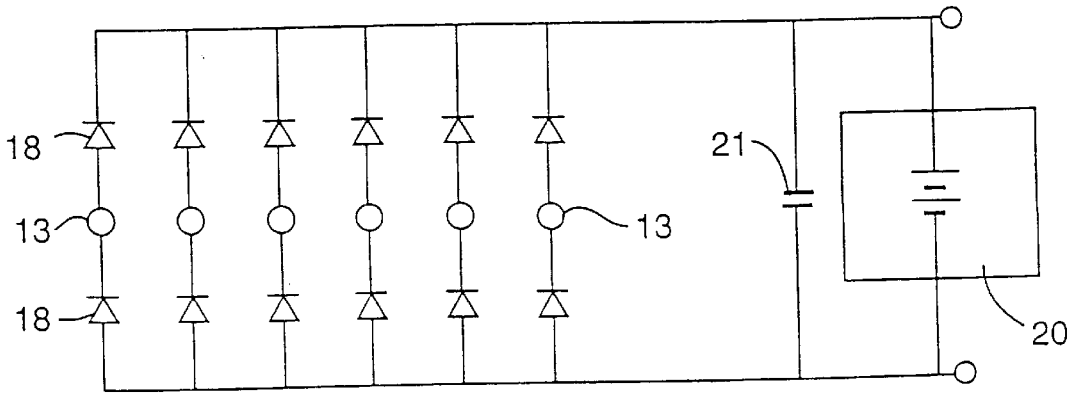
FIG. 4 is a schematic diagram of a voltage rectifier and stabilizing circuit in accordance with this invention.

Though not required for continuous operation, vehicles can also employ small storage batteries to stabilize the voltage supply. In operation, the battery 20 (schematically shown in FIG. 4) would be in the charging mode but during intervals where contacts 13 are not supplying sufficient current, the battery would provide sufficient energy until the electrical connection between the strips and the linkage is reestablished. The batteries could also supply sufficient current for limited "off track" paths to be used, assuming the vehicle control and communication is separate from any signal provided through the conductive portions of the track.

Vehicle 7 can be a conventional radio controlled frequency vehicle which is well known in the industry. Radio frequency vehicles are particularly well adapted for application where some limited "off track" use is intended. A conventional radio frequency battery powered vehicle is easily adapted for use with the present invention by providing a linkage 13 which connects directly to the electrical control system of the vehicle and disabling any low battery detector which may be present. It is envisioned that a radio frequency vehicle can be supplied with exchangeable components such that a battery compartment can be replaced with a linkage apparatus as described above. Alternatively, a switch could select between the conventional battery operation versus the linkage operation on the electrified track. A dual capability vehicle would preferably have a removable cover to protect the linkage contacts when the battery operated vehicle is used over terrain which might damage the linkage.

The switch-over between battery and platform operation can be automatic. Well known circuits are used to automatically switch between battery operation and a preferred external power source as is commonly used in numerous household electronic devices.

An alternative control system for the vehicle is accomplished through the transmission of control signals through the electrified track. For example, an encoding technique, such as frequency shift keying, can be used to communicate the date through the track with a modulated carrier. Established addressing protocols enable control center each to communicate with its own car with no interference to nearby platforms.

The basic track layout described above offers numerous advantages over conventional electric race tracks. One, the operator has complete control over the speed, position, and direction of the vehicle. Having a track responsive over its entire length and width enables a track to be provided which could easily accommodate more than two cars at a time. The use of an external power source, supplied through the track, maintains the vehicles at a top operational speed and without the need for frequent down time to replace expensive batteries or recharge the batteries.

The track system with the present invention introduces a level of skill and realism to electric track car racing not presently available. In addition to the control options, the present track system offers the capability of a wide variety of enhancements.

For instance, the electric track platform 1 can provide a series of spaced apertures for the insertion of accessory components. Buildings (31*b* in FIG. 6), load markings, barricades, or structural templates can be supplied as snap-in or insertable components carried by the platform.

The insertion means can also be designed so that the connections will tap into the electrical system of the track. This feature enables lights or structures to be illuminated or motorized parts to operate off the track power as well as being controlled by encoded signals.

A more versatile track layout is provided by structures having a coated magnetic base (base 31*a* in FIG. 1), the magnet allowing the structure to be placed anywhere along the platform, assuming metal conductors are used. Incorporating a linkage array as part of the structural base allows the structure to interact with the electrical system of the platform. For example, sign 31, seen in FIG. 1, can be provided with at least one linkage array, such as linkage array 11 in FIG. 3, on its base, which is in communication with the platform. Lights 33 can then be operated off the platform power supply. Likewise, a coded signal through the track permits the structures, such as lights, to be operated and to interact with other platform activities.

By way of example, a realistic race track environment can be provided with a defined pit area, course hazards, and/or an obstacle course. The interlocking panels enable creative course designs and may include banked turns, hills, and varied lanes. It is possible to create or duplicate a roadway racing circuit or highway system suitable for competition racing or time trials.

Similar to model railroad layouts, a complete road system can be provided with the electrical track. A large platform can be equipped with barricades and templates to define a particular course layout. Further, small panel portions can be combined to provide the course directly. Panels can provide curves, varying width lanes, hills, and deployed as part of a scaled recreation of road system complete with two-way traffic, multi-lane roads. intersections, bridges, overpasses, etc. The present invention also permits the track system to be integrated with a model railroad layout, bringing an enhanced degree of realism and interaction to the system.

The ability to provide a platform surface upon which a remotely controlled vehicle is energized, provides numerous opportunities for useful variations. For example, the vehicle can be a motorized wheeled figure in the form of a soccer player. Opposing teams comprising of individually controlled players are then used to direct a soccer ball into the opponent's goal. The goals can be magnetically attached to the platform surface as previously described. Movement of the ball by the player/vehicle can be by a simple bumping motion of the vehicle against the ball. Alternatively, a "foot" or other kicking member can be provided by a controllable pivoting leg or similar member for more realistic passing and scoring opportunities. The number of players per team can vary as can the size of the platform/field. In a matter of seconds, the soccer goals can be removed and the platform converted to a more conventional race track appearance.

The present invention is suitable for use as a recreational device at home or as an arcade type amusement device. The interlocking panels enable platform and track arrangements of virtually any size, shape, pattern or configuration. Likewise, there is no upper limit on the size of the vehicles which can be operated. For instance, full size vehicles suitable for industrial applications, such as robotic systems and inventory machinery, can be operated on a track system. Such a system has the advantage over battery operated industrial vehicles which require periodic recharging of batteries.

The present invention also provides for an improved track for use with remotely operated vehicles, as particularly illustrated in FIGS. 5–9. The track includes a plurality of panels 109 with each panel having a number of sides 206, as particularly illustrated in FIG. 5. Each of the sides of the panels includes a mechanical interlocking mechanism, such as pins A and sockets B illustrated in FIG. 5, and an electrical interlocking mechanism, such as the device illustrated in FIG. 5 and discussed above, so that any one of the panels can be mechanically and electrically connected to the other panels on every side 206 thereof, regardless of the orientation of the panels. The only requirement in connecting the panels is to ensure that an electrical connection is established for the conductors 117, 119 at the interface of the sides 206. In this manner, great versatility is provided in that the panels can be connected in any desired pattern or shape. Any given panel can have at least one additional panel connected on every side thereof.

Figure 6:
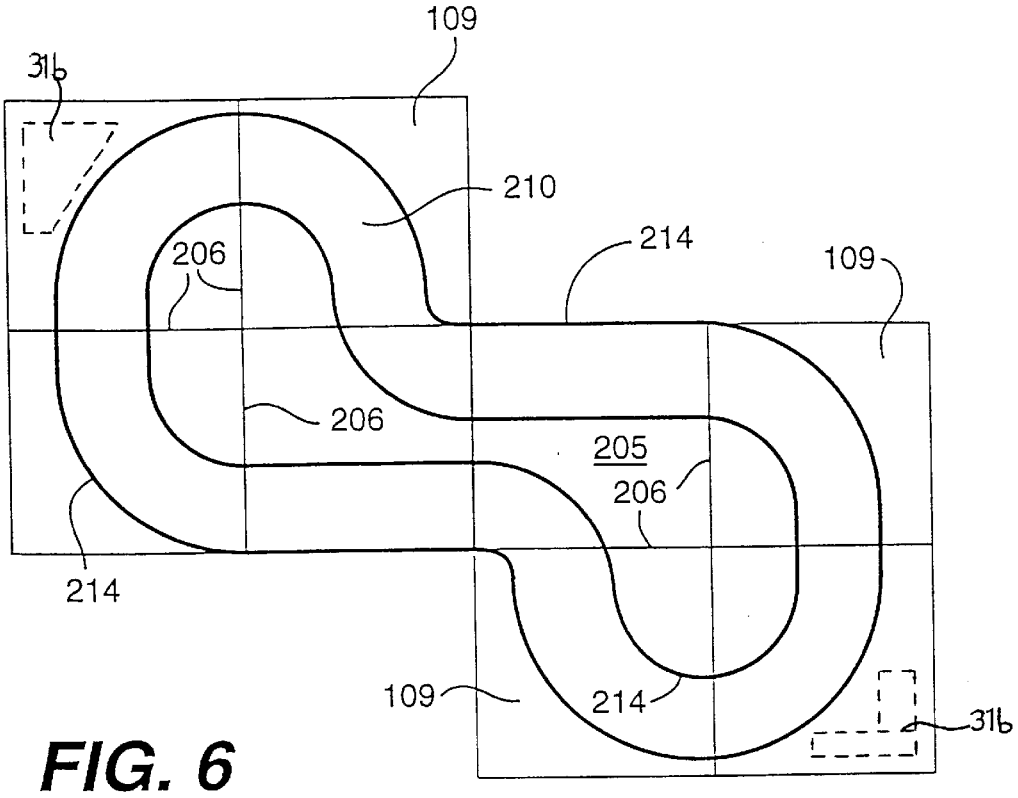
FIG. 6 is a schematic view of the interlocking panels with a course laid out thereon with barriers attached to the upper surface of the panels.
Figure 7:
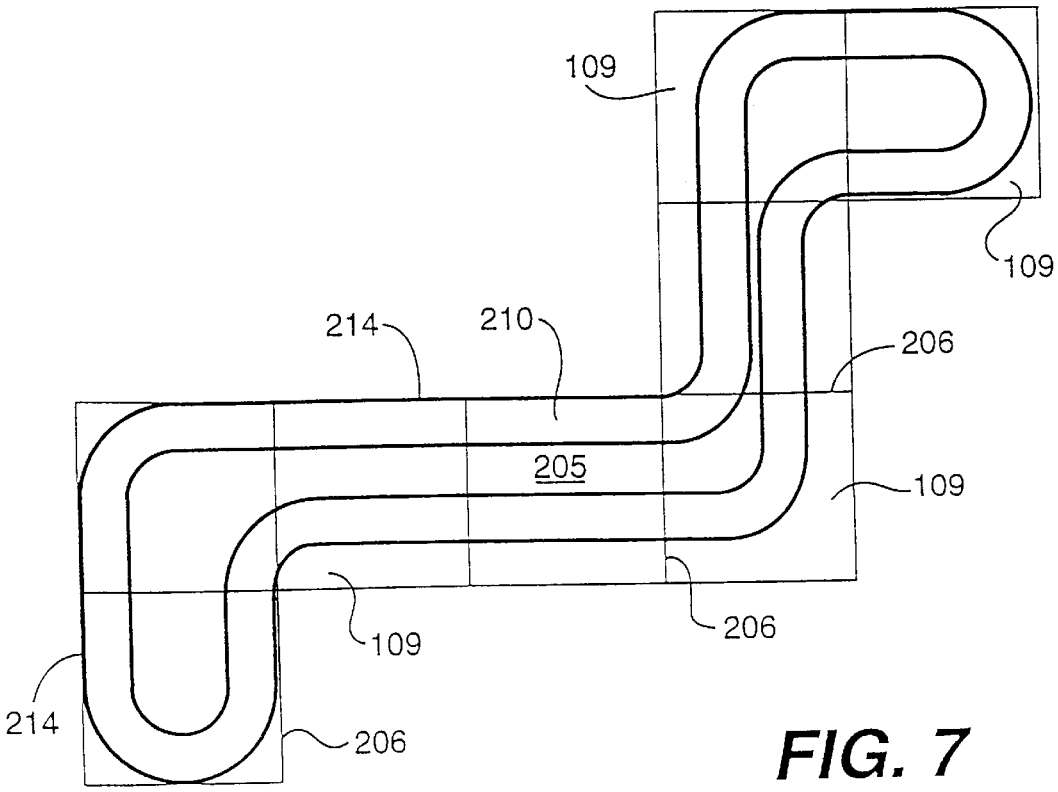
FIG. 7 is a schematic view of an alternative course and panel layout.

FIGS. 6 and 7 illustrate various arrangements of panels 109 made possible by the complimenting electrical and mechanical interlocking mechanisms between the sides 206 of the panels. Regardless of the pattern of the connected panels 109, the entire upper surface 205 of all the connected panels 109 forms a continuous conductive track for the vehicles.

It should be understood that any number of conventional mechanical and electrical connecting devices may be used to connect the panels together. The examples illustrated, particularly in FIG. 5 are merely examples. Any number of known mechanical and electrical connecting devices can be used in this regard.

FIGS. 6–9 illustrate an additional beneficial feature of the present invention. When connected together, the entire surface 205 of panels 109 forms a conductive surface for the vehicles. However, it may be preferred to define or set out a particular course or track on surface 205. In this regard, a number of barriers or obstacles 214 can be attached to surface 205 of each of the panels 109.

Figure 8:
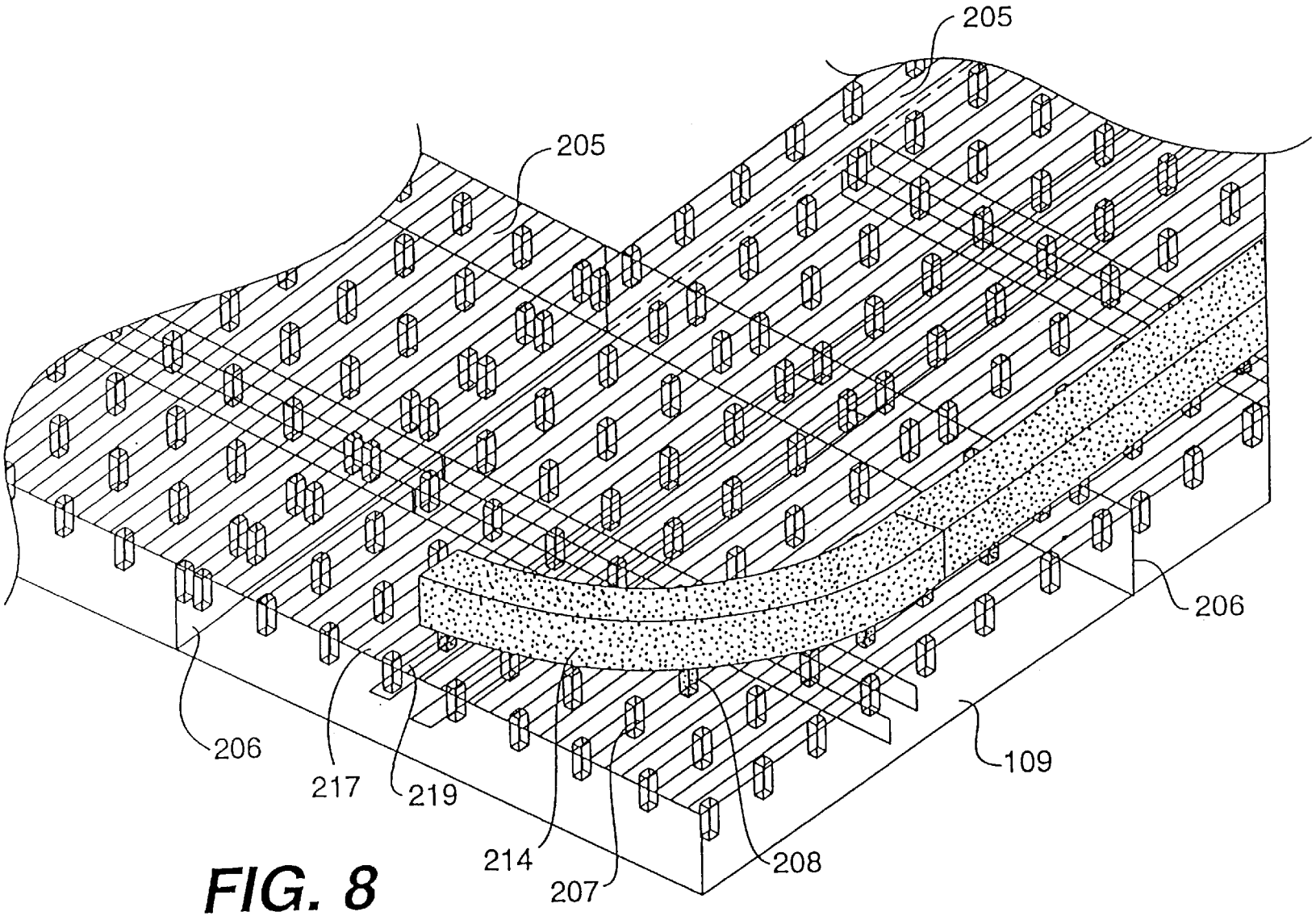
FIG. 8 is a perspective view showing internal details in phantom of a preferred panel construction, particularly illustrating attaching devices for the course barricades and the interlocking mechanical and electrical connections on each side of the panels.
Figure 9:
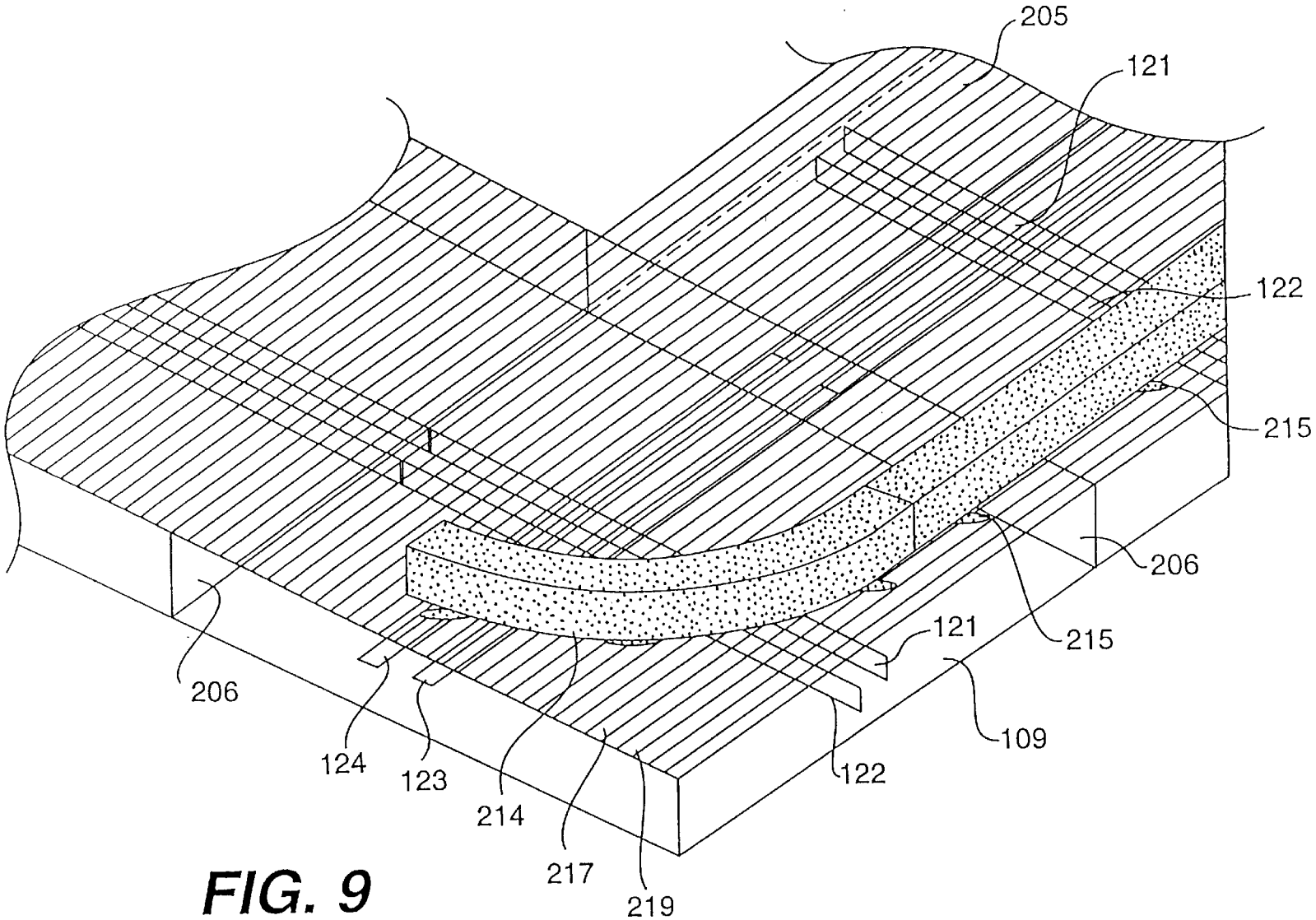
FIG. 9 is a perspective view showing internal details in phantom similar to FIG. 8, and particularly illustrates the magnetic connecting feature for the course barricades.

FIG. 8 illustrates an embodiment wherein barriers 214 are connected to the panels by a mechanical mechanism. In FIG. 8, male extending portions 208 fit into female recesses 207 defined throughout panel 109. In an alternative embodiment illustrated in FIG. 9, a magnetic connection 215 is established between barriers 214 and top surface 205, as previously discussed. The barriers may contain magnets which attach directly to the surface 205 of the panels. Therefore, it should be understood, that the barriers can be manipulated or arranged in any desired pattern on surface 205 in order to establish any manner of course or track for the vehicles. Barriers 214 can comprise any conventional physical defining structure, such as guard rails, buildings (31*b*), barricades, etc. Essentially, the only requirement is that the barriers 214 can be held stationary on surface 205. Any manner of known conventional devices can be utilized to hold barriers 214 stationary. Also, the barriers 214 may rest on surface 205 by gravity and friction alone.

Figure 10:
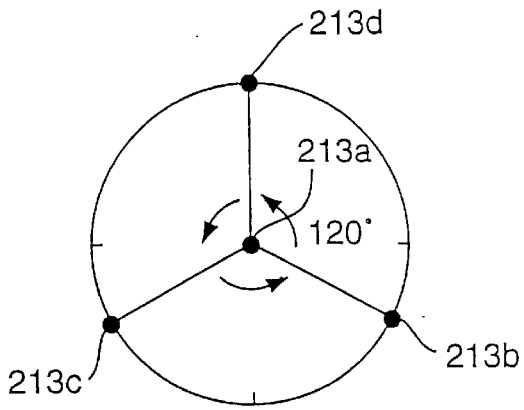
FIG. 10 is a diagrammatic plan view illustrating the circular pattern of the vehicle contacts.
Figure 11:
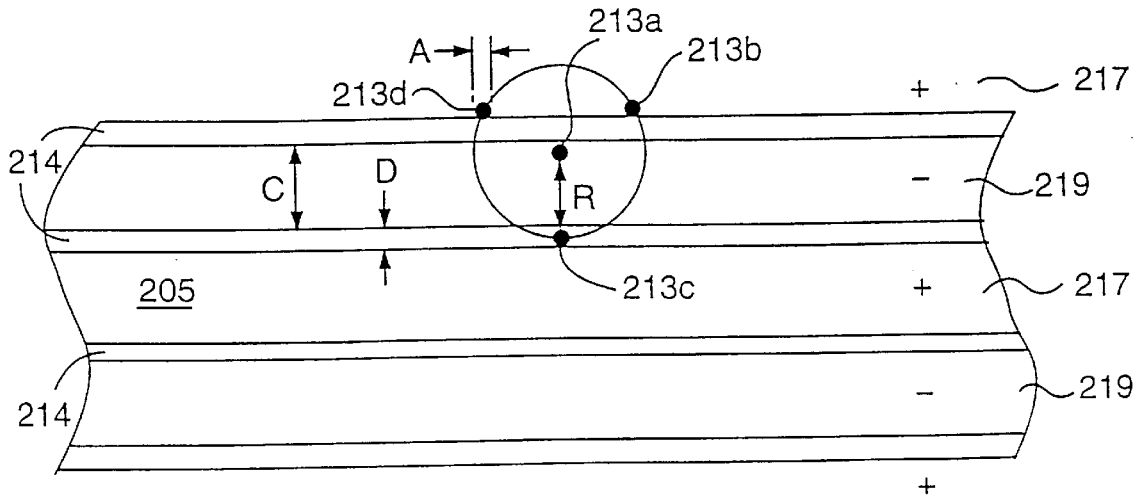
FIG. 11 is a diagrammatic view of the contacts illustrated in FIG. 10 in actual use on a track.

FIGS. 10 and 11 illustrate an additional preferred arrangement of the contacts on the bottom of the vehicle. In order to maximize the performance of the vehicles, it is desired to minimize the number of contacts and contact drag on surface 205. The fewer number of contacts used, the smaller the drag resistance will be. However, as discussed above, one or more of the contacts must be in contact with a positive conductor, and one or more contacts must be in contact with a negative conducting portion of surface 205. Applicants have found that the arrangement of contacts illustrated in FIGS. 10 and 11 satisfies this requirement and provides a minimal number of contacts and minimal drag.

Referring to FIG. 10, contacts 213*a*–213*d* are illustrated. The contacts are carried on the linkage of the vehicle as described above. Contacts 213*a*–213*d* are round point contacts and are arranged in a circular pattern along the bottom surface of the vehicle. One contact 213*a* is disposed in the center of the circular pattern and the remaining contacts 213*b*–213*d* are disposed equally spaced on the circumference of the circular pattern. In this manner, at least two of the contacts are always in contact with two conductors, regardless of the direction of movement of the vehicle on the platform, as particularly illustrated in FIG. 11.

Applicants have determined that certain dimensional characteristics of the contacts relative to the conducting and nonconducting portions of surface 205 provides the necessary contact relationship. Referring particularly to FIG. 11, round contacts 213*a*–213*d* have a diameter A. The width of negative and positive conductors 217, 219 have a width C. Nonconductive portions 214 have a width D. The circular pattern of the contacts has a radius R. To ensure that no dead spots exist between the contacts and conductors, the following geometrical relationship is preferred: diameter A of the contacts is less than width D of the nonconducting portions; radius R of the circular pattern is generally equal to width C of the conductive portions; and width D of the nonconducting portions is generally equal to one-half of radius R minus diameter A of the contacts.

It should be understood by those skilled in the art that some variation from the ideal geometric relation cited above is acceptable without dead spots occurring in the pattern.

The present invention also includes an electric model vehicle having the contact arrangement described above.

It will be apparent to those of skill in the art that various changes and substitutions can be made to the embodiments described herein without departing from the spirit and scope of the present invention as defined by the appended claims.

What is claimed is:

1. An electric apparatus comprising:

a platform having a plurality of equally spaced conductors of alternating positive and negative polarity, said conductors being carried by an upper surface of said platform;

a remotely controlled electric vehicle having a linkage carried by said vehicle;

at least three pairs of electrical contact surfaces carried by said linkage, said pairs of electrical contact surfaces being longitudinally spaced along the bottom surface of said vehicle and being positioned relative to each other in a laterally extending direction so that at least two of said contact surfaces are always in contact with the two conductors, regardless of the direction of movement of said vehicle on said platform;

a voltage rectifier circuit for supplying a respective positive and negative voltage from said platform conductors to said vehicle;

wherein when said vehicle is on said platform, said linkage contains an operative electrical connection with said platform conductors at all times, thereby permitting the vehicle to be operated along all points and in any direction relative to the platform.

2. The electric apparatus according to claim 1, wherein said platform is comprised of a nonconductive material.

3. The electric apparatus according to claim 1, wherein said spaced conductors are defined by a plurality of adjacent parallel strips.

4. The electric apparatus according to claim 1, wherein said platform is further defined by a plurality of panels, each said panel being in communication with the other said panels.

5. The electric apparatus according to claim 1, wherein said spaced conductors are arranged in a non-linear geometric pattern.

6. The electric apparatus according to claim 1, wherein said spaced conductors of said platform further carry an encoding signal, said vehicle responding to said signal.

7. The apparatus as in claim 1, wherein said vehicle further comprises an alternate power source for supplying power thereto when said vehicle is not in contact with said conductors.

8. The apparatus as in claim 7, wherein said alternate power source comprises a battery.

* * * * *